United States Patent [19]

Hillin

[11] Patent Number: 4,697,443

[45] Date of Patent: Oct. 6, 1987

[54] MULTI-LOCK SECURITY DEVICE

[76] Inventor: Wilbert L. Hillin, Rte. 3, Box 157, Buna, Tex. 77612

[21] Appl. No.: 10,205

[22] Filed: Feb. 3, 1987

[51] Int. Cl.[4] ..... E05B 65/14

[52] U.S. Cl. ..... 70/121; 70/135; 70/DIG. 63; 292/54; 292/205

[58] Field of Search ..... 70/121, 122, 123, 135, 70/138–139, 14, 101, 134, DIG. 63; 292/54, 205

[56] References Cited

U.S. PATENT DOCUMENTS

| | | | |
|---|---|---|---|
| 679,337 | 7/1901 | Reynolds | 70/DIG. 63 |
| 1,112,279 | 9/1914 | Ferris . | |
| 1,961,041 | 5/1934 | Gilbert | 70/14 |
| 2,707,125 | 4/1955 | Ritter | 292/341.15 |
| 2,856,220 | 10/1958 | Easley | 292/148 |
| 2,963,895 | 12/1960 | Thomas | 70/14 |
| 3,656,789 | 4/1972 | Ray | 292/205 |
| 3,731,505 | 5/1973 | Rosenberg | 70/63 |
| 3,889,497 | 6/1975 | Tuttle | 70/14 |
| 3,926,018 | 12/1975 | Joersz | 70/19 |
| 3,988,031 | 10/1976 | Meyer | 292/153 |
| 4,085,599 | 4/1978 | Fischer | 70/14 |
| 4,240,278 | 12/1980 | Linder | 292/205 |

*Primary Examiner*—Robert L. Wolfe

*Attorney, Agent, or Firm*—Pravel, Gambrell, Hewitt, Kimball & Krieger

[57] ABSTRACT

A multi-lock security device for providing access to a secured area by releasing any one of a number of locks. The device includes a locking plate rotatably disposed on a stationary axis, said axis secured to an existing structure or itself embedded in the ground. The locking plate is provided with a series of radial access channels formed through a flanged retaining rib disposed on said lock plate, thereby enabling the gate pin to be slidably held within an interior latch race. Fastening gates are pivotally attached on the locking plate and may be closed across the access channels and secured with padlocks connectable through corresponding openings in both the fastening gate and the locking plate.

11 Claims, 4 Drawing Figures

Fig. 4
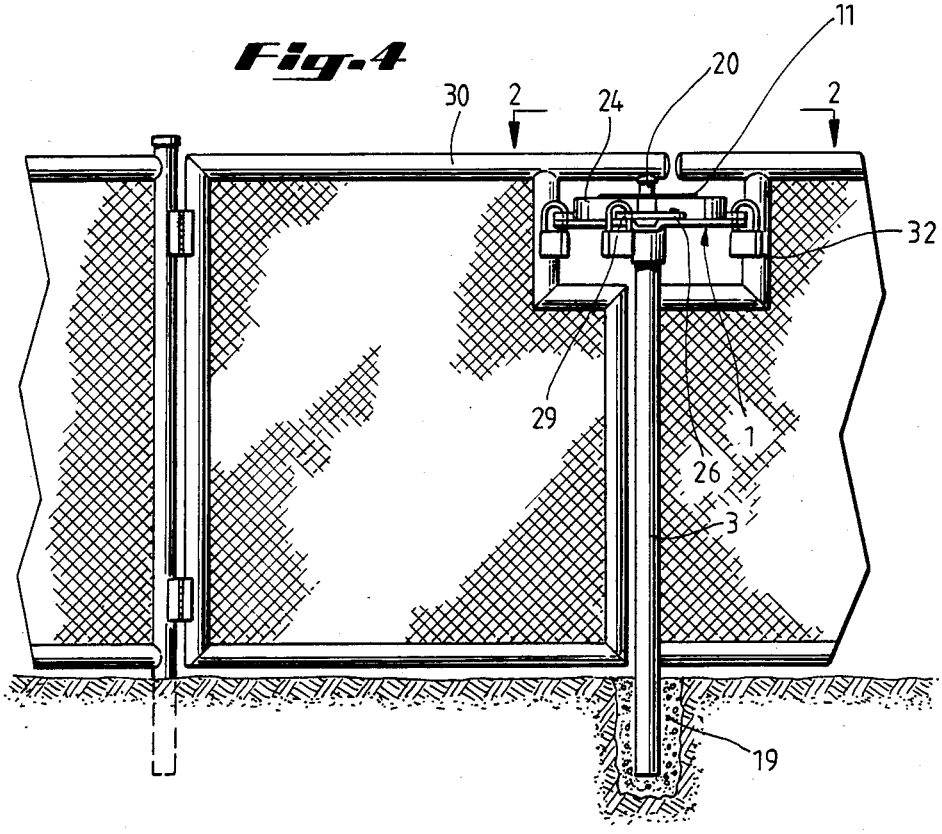
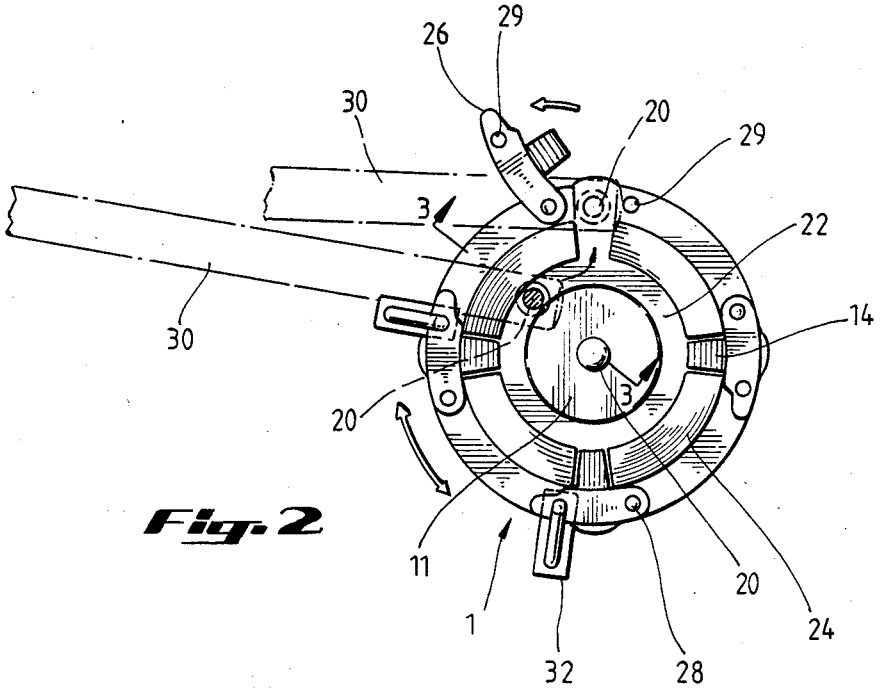
Fig. 2

MULTI-LOCK SECURITY DEVICE

BACKGROUND OF THE INVENTION

The present invention relates generally to a multiple lock security device for use in either private or commercial applications. More particularly, the present invention relates to a means that may be used with a combination of locks to restrict entry through a gate by unlocking any one of the multiple locks. This invention is particularly suited for use on gates wherein a large number of individuals may have their own lock and key for entry through a gate.

BRIEF DESCRIPTION OF THE PRIOR ART

Prior to the present invention, various locking mechanisms have been developed to secure a gate against unauthorized entry yet provide a means for access by multiple users. Most common of these mechanisms is the chain and lock setup, wherein a chain is wrapped around the gatepost and the fencepost and secured with a padlock or other similar locking device.

While structurally simple, the chain and padlock mechanism has many disadvantages. If the gateway accommodates a great number of users each requiring a separate lock and key, the chain soon becomes exceptionally cumbersome to use, due in part to the increased length of the chain as well as an increase in weight due to the number of locks affixed to it. This increased length and weight of this setup is especially disadvantageous when access through the gate is attempted at night or in inclement weather.

Another disadvantage of the chain and lock system is the possibility that a given user may bypass, either intentionally or inadvertently, a number of other locks when re-securing the chain, thus denying access through the gate by a number of authorized users whose locks are secured in the bypassed area. Conversely, the chain and lock system provides an opportunity for systematic and unauthorized entry through the gate whereby a link in the chain is removed and replaced with an unauthorized lock. In this latter occasion, opportunity for access through the gate by unauthorized persons is made both convenient and almost undetectable.

Other mechanisms have been developed to facilitate access through a gate by a variety of users in which each require a different lock and key. One such device was described in U.S. Pat. No. 2,707,125, which showed a series of locks used in combination with a gatepost. In this device, if one of the locks were removed, an integral portion of the gate could slide upward thereby moving a pin to release a locking bar. The shortcomings of this device include both its complexity and expense of construction, as well as its complexity of operation.

Another multiple locking apparatus was described in U.S. Pat. No. 3,988,031, which showed a horizontal rotary barrier plate built into a gate or fence, whereby the user could access the gate by removing any one of a number of padlocks. By removal of one of these locks, a covering means attached to the plate could be pivoted aside, thus revealing a portal through which the locking bar could be moved, thereby enabling the gate to be opened. Disadvantages associated with this system include the need for visual alignment of the locking bar and portal during operation, thus making night operation difficult or impossible. Further disadvantages associated with this system include the restriction of its use to those situations where the gate and fence have not experienced sag or warp.

SUMMARY OF THE INVENTION

The present invention overcomes many of the disadvantages of the prior art locking systems by providing a simple, secure locking apparatus that can be used in a variety of applications.

In one preferred embodiment of the present invention, a rotatable locking plate is carried on a stationary axis that may be located on or proximate to a gate or fence. The locking plate is fitted with one or more channels or grooves that accommodate a gate pin or latch. Pivotally secured to the locking plate are a number of fastening gates which can be moved across these channels in the locking plate to impede and prevent the movement of the gate pin. These gates can be secured by corresponding openings in the fastening gate and the locking plate, through which padlocks can be connectively attached. A latch race is formed on the face of the locking plate by the combination of a locking ring and a retaining rib. Both the locking ring and the retaining rib may be welded to the locking plate or may be attached by fasteners or the like. The channels formed at the outer diameter of the locking plate lead to the latch race, which secures the flanged latch pin in a slidable engagement with the locking plate.

To use the present device, the user simply rotates the locking plate about the axis until a particular padlock is selected. When the lock is removed, the user pivots the fastening gate away from the latch channel and removes the latch pin from the latch race through the channel formed in the locking plate, thereby allowing the gate to be opened.

The present invention should provide many advantages over the prior art. First, the rotatable nature of the device allows the user greater flexibility and convenience in access of a given padlock. Unlike prior art devices which require the user to bend or stoop to find a particular lock, the present device is operable from any desired height and can be accessed from any variety of angles.

The present invention also provides a means for securing a gate or other opening which may be easily accessed at night by the placement of a braille-like indicator code on the fastening gates. By the placement of such a code, the present device may be easily operated at night without the need for a flashlight, lantern, etc. This feature is felt to be of particular importance to security personnel, game wardens, or military personnel who might have a need for silent operation.

The present invention also provides the landowner with greater flexibility in its installation. Unlike prior art devices which become inoperable when the closure elements of the gate or fence begin to sag or warp, the present device remains operable in a variety of exaggerated structural conditions.

It is an object of the present invention to provide a novel and improved locking mechanism which can be used to restrict access through a gate or other opening which requires access by a number of different individuals, each having their own separate lock and key.

It is a further object of the present invention to provide a locking mechanism which is not easily subject to tampering and one in which the addition or deletion of a given lock is more readily apparent, thereby deterring unauthorized access.

It is a further object of the present invention to provide a locking mechanism that is capable of operation even when the gate or fence to which it is attached suffers sag or displacement.

It is still a further object of the present invention to provide a locking mechanism that can be easily accessed and opened by a wide range of persons of different height in all varieties of weather, and especially at night.

BRIEF DESCRIPTION OF THE DRAWINGS

FIG. 1 is an exploded perspective view of one embodiment of the present invention.

FIG. 2 is a top view which illustrates one embodiment of the interaction of the gate pin as it moves in contact with the locking plate.

FIG. 4 is a side view which illustrates one embodiment of the overall relationship of the locking plate, the stationary axis and the gate.

DETAILED DESCRIPTION OF THE PREFERRED EMBODIMENT

Figure 3:
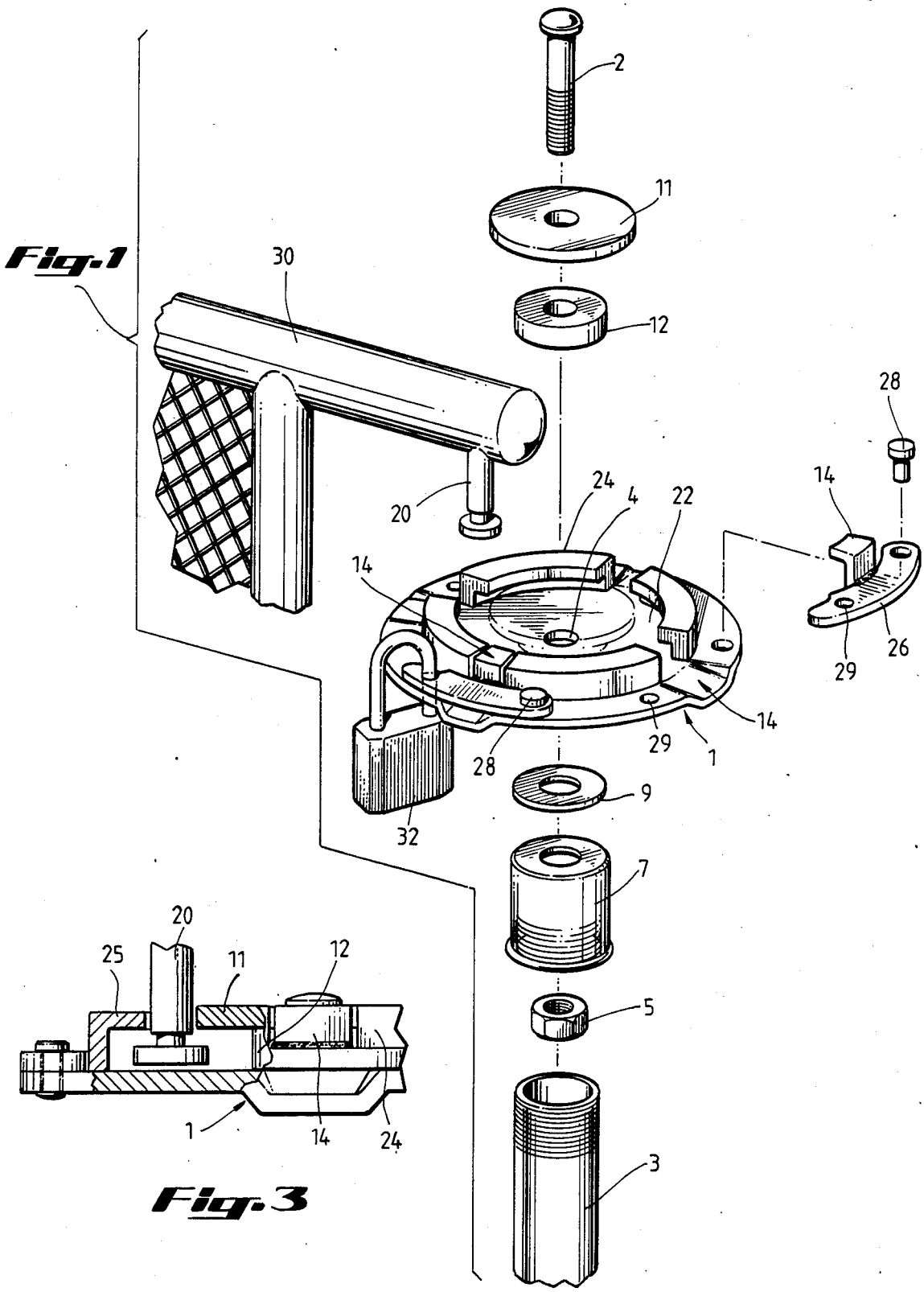
FIG. 3 is a side view which depicts the relationship of the gate pin to the lock race.

FIG. 1 generally illustrates the component parts of a presently preferred embodiment of the multi-lock security device. In this device, a locking plate 1 is rotatably attached to the free end of a stationary axis member 3, by way of an appropriately sized hole or opening 4, the opposite end of said axis member 3 being attached to a gate or fence or securely embedded in the ground. In one embodiment of the present device, a fastening means 5 such as a nut or the like and a rotation cap 7 are threaded and secured by a fastening means 2 onto the upper end of the axis member 3 in order to conveniently set the height of the locking plate 1 in relationship to the user and the gate arm 30. Onto the rotation cap 7 may be placed a silicone washer 9 or other similar means to facilitate the rotation of the locking plate 1 by the user when a search is made for a particular lock 32. It is also contemplated that it may be convenient to insert a bearing or a suitable lubricant between the rotation cap 7 and the locking plate 1 as to facilitate operation.

Above the locking plate 1 and below the locking ring 11, a spacer 12 may be inserted to accommodate a given gate pin 20. In one embodiment of the invention, the gate pin may be a flat headed bolt or the like. In other embodiments, a specially designed pin or latch may be used.

In the locking plate 1, any number of access grooves or channels 14 may be provided to allow the gate pin 20 to move from the open position through channels 14 and into the latch race 22, whereby the gate may be secured. These grooves 14 are provided radially in the locking plate 1 and provide a means for the gate pin 20 to move past the retaining rib 24.

Fastening gates 26 are pivotally attached to the locking plate 1 by rivets 28 or other suitable fasteners. Corresponding holes 29 or notches are provided in both the fastening gates 26 and the locking plate 1, whereby a padlock 32 or other locking means may be connected therethrough to restrict the movement of the fastening gate 26.

FIG. 2 generally illustrates the interaction of the gate pin 20 as it is held within the latch race 22 formed by the retaining rib 24 and the locking ring 11. When the gate pin 20 is held within the race 22, the locking plate 1 may be rotated to select a given lock 32. When the lock 32 is removed from a particular fastening gate 26, the fastening gate 26 may be pivoted to an open position to allow the gate pin 20 to exit the race 22 via access channels 14 provided in the retaining rib 24.

FIG. 3 generally illustrates the way in which the gate pin 20 is held within the race 22 by way of a lip 25 provided in the retaining rib 24 and by the overlap of the locking ring 11 over the washer 9. In this fashion, the gate pin 20 may only move in a plane parallel to that of the locking plate 1.

FIG. 4 generally shows a side view of the stationary axis 3, the locking plate 1 and the gate arm 30 and pin 20. In this side view, the gate pin 20 distends vertically from the gate arm 30 and perpendicularly contacts the top side of the locking plate 1 and is held securely with the latch race 22 (not shown) formed by the locking ring 11 and the retaining rib 24. Fastening gates 26 are held in the closed position by a plurality of locks 32 which are connected through corresponding holes 29 provided in both the fastening gate 26 and the locking plate 1.

What is claimed is:

1. A multiple lock security device comprising:

a mounting axis;

a gate pin or latch having a broadened or flanged free end such as to slidably fit within a latch race;

a locking plate rotatably mounted on said mounting axis, the locking plate having one or more radially formed access channels provided therein to accommodate the gate pin;

a locking ring or bracket attached or formed at the free end of the mounting axis and above the open side of the locking plate, the locking ring forming the inner diametrical boundary of a latch race and further serving to restrict the movement of the gate pin in the latch race in all planes other than that substantially parallel to the locking plate;

one or more fastening gates pivotally mounted on the locking plate and positioned whereby they may be closed across the access channels; and a retaining rib connected to or formed on the locking plate, whereby the rib forms the outer diametrical boundary of the latch race and further aids to restrict the movement of the gate pin in all planes except that substantially parallel to the locking plate.

2. The security device as described in claim 1 whereby the outer diametrical configuration of the locking plate is substantially circular in shape.

3. The security device of claim 2 whereby the locking plate is fitted with a number of fastening gates corresponding to the number of access channels provided in the locking plate.

4. The security device of claim 3 whereby the fastening gates are fastened to the locking plate in a manner such that they may be pivoted in a plane parallel to the locking plate.

5. The security device as described in claim 1 whereby both the inner and outer diametrical configuration of the latch race is substantially circular in shape.

6. The security device of claim 5 whereby the latch race is provided with a means to allow the gate pin to slidably move within the race only in a plane parallel to the locking plate.

7. The security device of claim 1 whereby the locking plate and the retaining rib are formed as a single unit.

8. The security device of claim 7 whereby the retaining rib is provided with a recessed lip or groove so as to slidably accommodate the flanged or ball contact extremity of the gate pin.

9. The security device of claim 1 whereby the gate pin contacts the locking plate substantially perpendicular to the locking plate.

10. The security device of claim 1 whereby both the locking plate and the fastening gates are provided with corresponding openings to accommodate a padlock, the number of openings in the locking plate corresponding to the number of fastening gates and access grooves.

11. A multiple lock security device which is comprised of a locking plate mounted on an axis, the locking plate having a plurality of radially formed channels or grooves to accommodate a gate pin or latch, the channels or grooves being closable by way of fastening gates or latches pivotally mounted on the locking plate, the fastening gates and the locking plates being provided with corresponding holes for the connection of a padlock therethrough, the locking plate also being attachably provided with a locking ring and a retaining rib disposed thereon to form a locking race whereby the gate pin might be held in slidable connection with the locking plate.

* * * * *